US012209408B2

(12) United States Patent
Otsuka

(10) Patent No.: US 12,209,408 B2
(45) Date of Patent: Jan. 28, 2025

(54) SOUND-PROOF STRUCTURE FOR BUILDING

(71) Applicant: TSUNAGARU DESIGN Inc., Tokyo (JP)

(72) Inventor: Gorouemon Otsuka, Tokyo (JP)

(73) Assignee: TSUNAGARU DESIGN Inc., Tokyo (JP)

( * ) Notice: Subject to any disclaimer, the term of this patent is extended or adjusted under 35 U.S.C. 154(b) by 0 days.

(21) Appl. No.: 18/795,016

(22) Filed: Aug. 5, 2024

(65) Prior Publication Data

US 2024/0392559 A1 Nov. 28, 2024

Related U.S. Application Data

(63) Continuation of application No. PCT/JP2022/028177, filed on Jul. 20, 2022.

(30) Foreign Application Priority Data

Feb. 16, 2022 (LU) ..... 2022-021778

(51) Int. Cl.
*E04B 1/82* (2006.01)

(52) U.S. Cl.
CPC .... *E04B 1/8218* (2013.01); *E04B 2001/8254* (2013.01); *E04B 2001/8263* (2013.01)

(58) Field of Classification Search
CPC ..... E04B 1/8218; E04B 2001/8254; E04B 2001/8263
See application file for complete search history.

(56) References Cited

U.S. PATENT DOCUMENTS 7,076,922 B1 * 7/2006 Parres ..... E04B 1/8218 52/79.5
2002/0157898 A1 * 10/2002 Dutton ..... E04B 1/8218 181/284

(Continued)

FOREIGN PATENT DOCUMENTS

DE 202018105652 U1 * 11/2019 ..... E04B 1/34321
JP H01-287342 A 11/1989

(Continued)

OTHER PUBLICATIONS

English Translation of International Search Report dated Aug. 24, 2023, mailed in counterpart International Application No. PCT/JP2022/028177, 3 pages.

*Primary Examiner* — Forrest M Phillips
(74) *Attorney, Agent, or Firm* — Kim & Stewart LLP

(57) ABSTRACT

A soundproof building structure includes a first structure including a first floor, a first wall, and a first ceiling, each of which is concrete, a second structure inside the first structure and including a second floor having a vibration isolation structure on the first floor, a steel frame structure standing on the second floor apart from the first wall below the first ceiling, a second wall including a sound insulation board on an interior side of the frame structure, and a second ceiling including a sound insulation board on the interior side, and a third structure inside the second structure and including a detachable flat panel on an interior side of the second wall. An upper end of the panel fits into a rail fixed to a ceiling member of the frame structure, and a lower end of the panel fits into a rail fixed to the second floor.

19 Claims, 5 Drawing Sheets

(56) References Cited

U.S. PATENT DOCUMENTS

| | | | | |
|---|---|---|---|---|
| 2004/0065501 | A1* | 4/2004 | Tong | G10K 11/168 181/290 |
| 2007/0267247 | A1* | 11/2007 | Tartsch | E04B 1/8218 181/288 |
| 2016/0002915 | A1* | 1/2016 | Pearson | E04B 1/8218 52/506.05 |
| 2018/0347175 | A1* | 12/2018 | Anderson | E04B 1/3483 |

FOREIGN PATENT DOCUMENTS

| | | | | |
|---|---|---|---|---|
| JP | H05-52011 | U | 7/1993 | |
| JP | H07-034107 | U | 6/1995 | |
| JP | 3056355 | U | 2/1999 | |
| JP | 2002-276054 | A | 9/2002 | |
| JP | 2002-317509 | A | 10/2002 | |
| JP | 2012-001931 | A | 1/2012 | |
| JP | 2012-097452 | A | 5/2012 | |
| JP | 2016-204846 | A | 12/2016 | |
| WO | WO-2019077079 | A1 * | 4/2019 | |
| WO | WO-2020183445 | A1 * | 9/2020 | E04B 1/8218 |

* cited by examiner

SOUND-PROOF STRUCTURE FOR BUILDING

CROSS-REFERENCE TO RELATED APPLICATIONS

This application is a continuation application filed under 35 U.S.C. 111 (a) claiming benefit under 35 U.S.C. 120 and 365 (c) of PCT International Application No. PCT/JP2022/028177, filed Jul. 20, 2022, which is based upon and claims the benefit of priority of Japanese Patent Application No. 2022-021778, filed Feb. 16, 2022, the entire contents of which are incorporated herein by reference.

FIELD

Embodiments of the present disclosure relate generally to a soundproof structure for building.

BACKGROUND

There is a building, such as a housing complex or a studio, having a double soundproof structure that enables the playing of musical instruments. Generally, a building with a double soundproof structure has a sound insulation rating of about Dr-60 to Dr-70 and enables the playing of musical instruments, such as pianos, guitars, and woodwind instruments, with sound volume less than or equal to 100 dB.

For example, there is a conventional floating floor isolation structure in which a floating floor structure is isolated from a building structure. This configuration prevents sound generated by a sound source in a soundproof space from propagating through a "bridging material", such as a ceiling or a wall, and makes it possible to improve soundproof performance and sound insulation performance.

Here, with the related-art soundproof structure, when a sound insulation performance test is conducted after the completion of construction, the inter-room sound insulation performance may vary by about 5 dB among soundproof rooms. In such a case, if, for example, a sound insulation wall material is added to a room with low sound insulation performance, the effective room area is decreased, and the size and the design of the room becomes inconsistent with other rooms. Therefore, it is practically impossible to correct the sound insulation performance after the completion of construction.

Also, in the case of, for example, rental housing in which occupants change frequently, it is not possible to predict what types of musical instrument and furniture are installed and where the musical instrument is played. Accordingly, it is not possible to optimize the acoustics (e.g., the clarity of sound and reverberation time) of a room in advance.

SUMMARY OF THE INVENTION

Embodiments of the present disclosure provide a soundproof building structure, the sound insulation performance and acoustics of which can be easily adjusted after construction.

According to an aspect of the present disclosure, a soundproof building structure comprises a first structure including a first floor, a first wall, and a first ceiling, each of which is a concrete structure; a second structure disposed inside the first structure and including: a second floor that has a vibration isolation structure and is on the first floor, a steel frame structure standing on the second floor apart from the first wall below the first ceiling, a second wall including a sound insulation board and disposed on an interior side of the steel frame structure, and a second ceiling including a sound insulation board and disposed on the interior side of the steel frame structure; and a third structure disposed inside the second structure and including a detachable flat panel disposed on an interior side of the second wall. An upper end of the detachable flat panel fits into an upper rail fixed to a ceiling member of the steel frame structure, and a lower end of the detachable flat panel fits into a lower rail fixed to the second floor.

DETAILED DESCRIPTION

Hereinafter, embodiments of the present disclosure are described in detail with reference to the drawings. However, components described in the embodiments are examples, and the present disclosure is not limited to the embodiments described below.

(Configuration)

Figure 1:
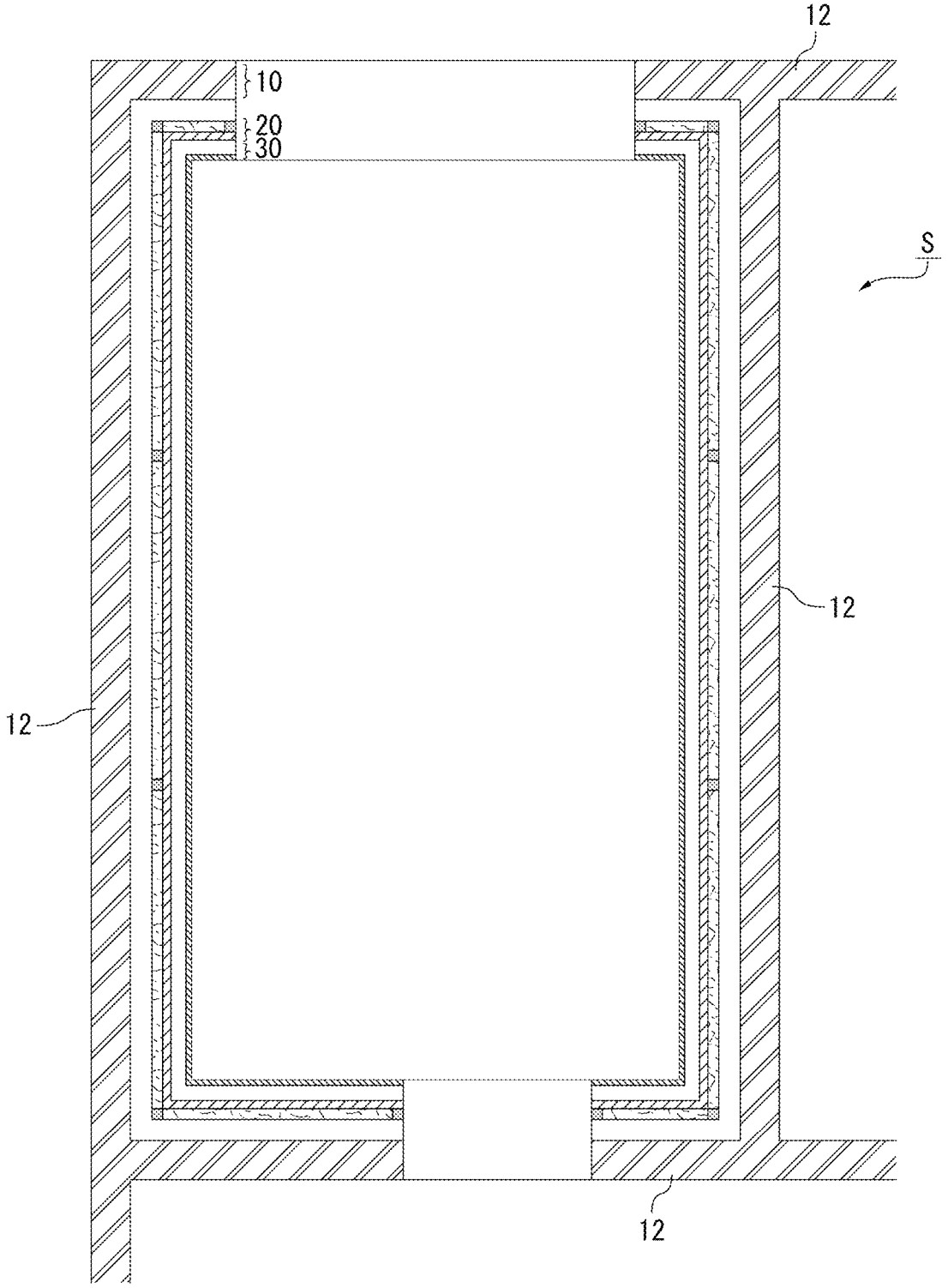
FIG. 1 is a cross-sectional view of a soundproof building structure.

First, an overall configuration of a soundproof building structure S according to an embodiment is described with reference to FIGS. 1 to 4. As illustrated in FIG. 1, the soundproof building structure S has a triple structure including a first structure 10, a second structure 20 constructed in the first structure 10, and a third structure 30 constructed in the second structure 20.

The first structure 10 includes a first floor 11, a first wall 12, and a first ceiling 13, each of which is a concrete structure. The thickness of each of the first floor 11, the first wall 12, and the first ceiling 13 is preferably, but not limited to, about 180 mm. Because the first structure 10 is a common concrete structure, descriptions of other details of the first structure 10 are omitted here. For example, the first floor 11 of a third floor apartment corresponds to the first ceiling 13 of a second floor apartment.

The second structure 20 includes a second floor 21 that has a vibration isolation structure and is constructed on the first floor 11, a second wall 22 that is constructed apart from the first wall 12, and a second ceiling 23 that is constructed apart from the first ceiling 13.

More specifically, the second structure 20 includes a steel frame structure 40 that is erected on the second floor 21, which is a floating floor placed on anti-vibration rubber 24 (or glass wool) formed on the first floor 11 of the first structure 10, and the second wall 22 and the second ceiling 23 attached to the steel frame structure 40.

Figure 2:
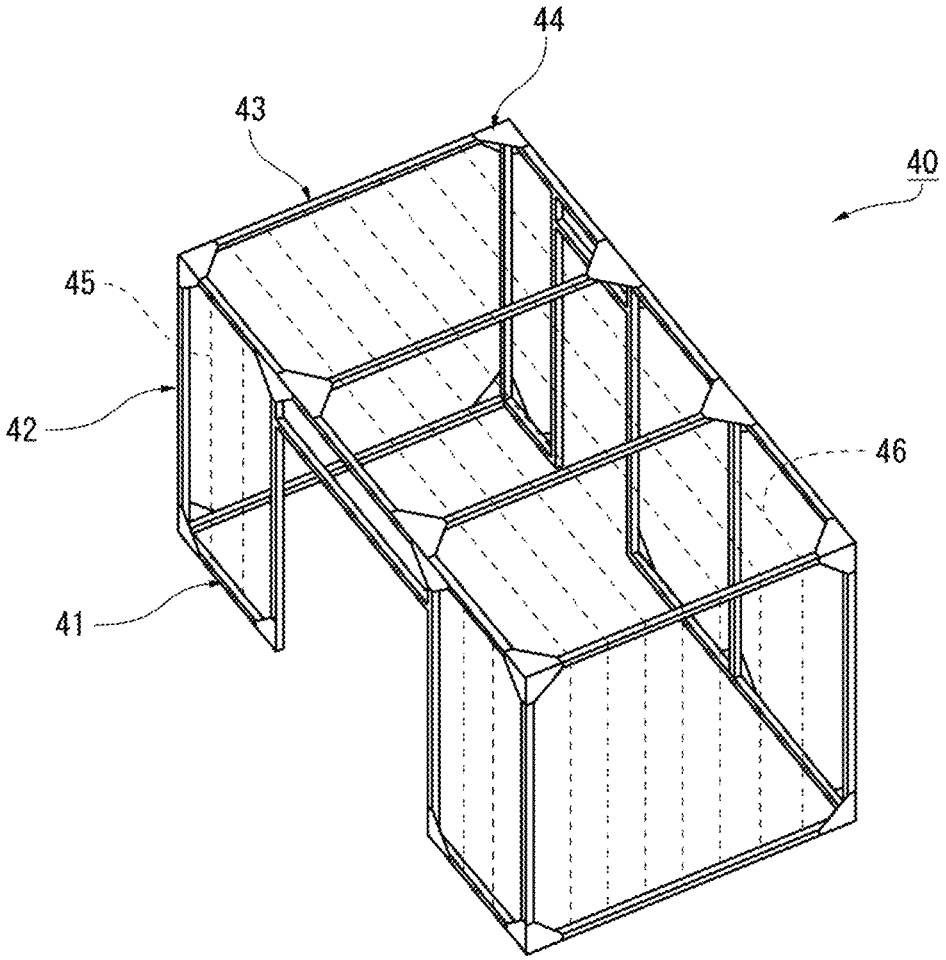
FIG. 2 is a perspective view of a steel frame structure.

As illustrated in FIG. 2, the steel frame structure 40 includes floor members 41, column members 42 erected on the floor members 41, and ceiling members 43 connecting the upper ends of the column members 42. The floor members 41, the column members 42, and the ceiling members 43 are formed of light gauge steel and have quadrangular cross sections. Reinforcement plates 44 are attached to the corners formed by the floor members 41, the column members 42, and the ceiling members 43. Furthermore, studs 45 are attached at predetermined intervals to the wall surface, and ceiling joists 46 are attached at predetermined intervals to the ceiling surface.

Figure 3:
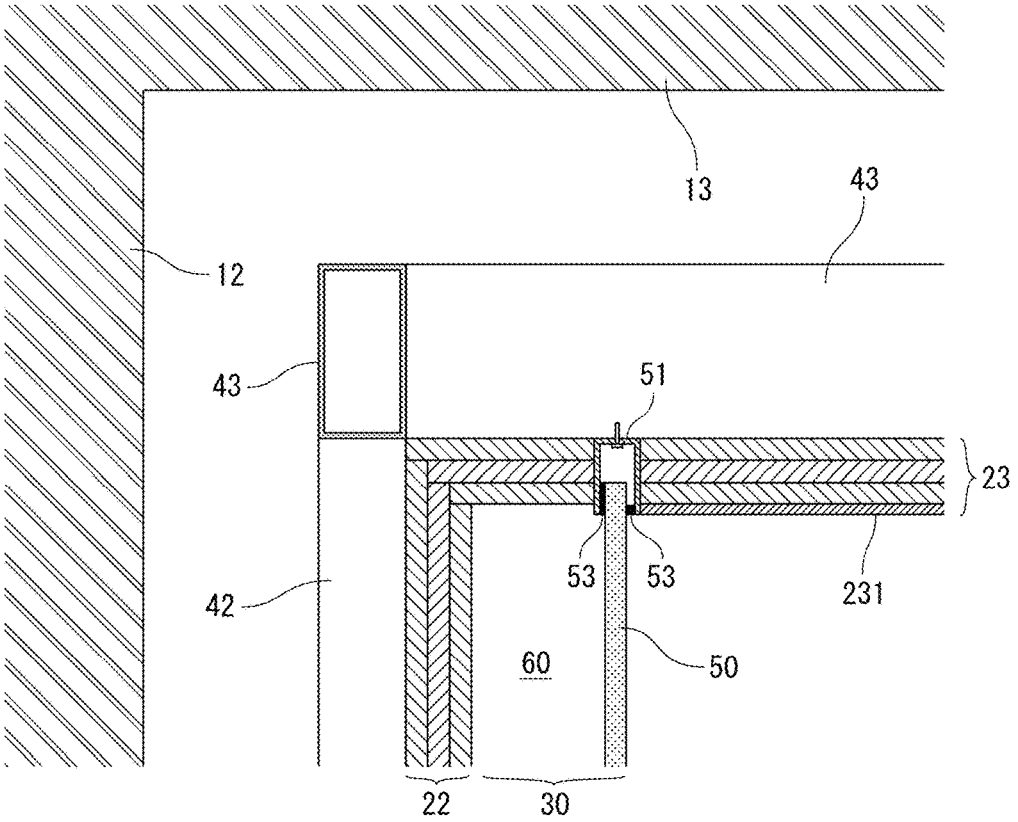
FIG. 3 is a cross-sectional view a portion of the soundproof building structure near a corner of a ceiling and a wall.
Figure 4:
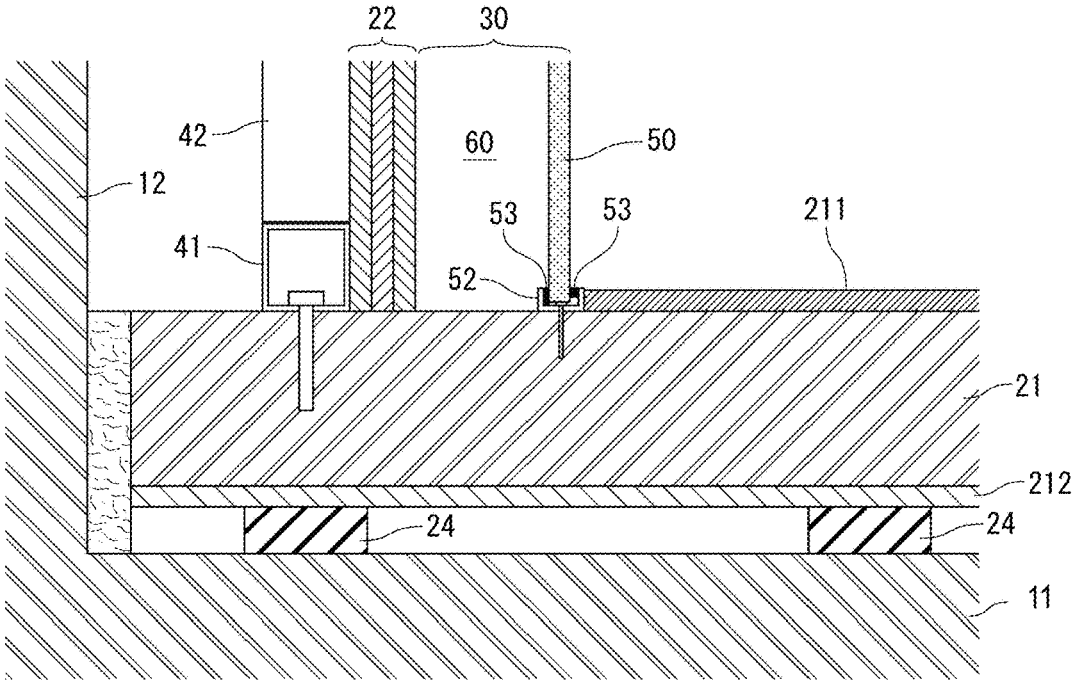
FIG. 4 is a cross-sectional view of a portion of the soundproof building structure near a corner of a floor and a wall.

More specifically, as illustrated in FIGS. 3 and 4, a sound insulation board implementing the second wall 22 is formed of three regular hard-type gypsum boards with a thickness of 12.5 mm. Similarly, a sound insulation board implementing the second ceiling 23 is also formed of three regular hard-type gypsum boards with a thickness of 12.5 mm. That is, the wall and the ceiling have the same sound insulation performance. Also, to support the load of these sound insulation boards (e.g., approximately 47.75 kg/m$^2$), the steel frame structure 40 implemented by SS400 is provided in the building structure of a soundproof room.

For example, a component of "–100×50 t3.2" is used for the ceiling members (i.e., beams) 43 of the steel frame structure 40, and a component of "a –50×50 t3.2" is used for the column members 42 and the floor members 41. Also, joists "C—100×50×20 t1.6" are arranged at a pitch of 303 mm between the beams. All sound insulation boards (i.e., the wall 22) are fully bonded to each other with a special dampening material and screwed to the steel frame structure 40. The steel frame structure 40 is securely fastened to the concrete floating floor 21 with a thickness of 100 mm or more by using Chemical Anchor®. The anti-vibration rubber 24 is provided below the concrete floating floor 21 to prevent the transmission of vibrations to the lower floor. An additional floor member 212 may be disposed between the floor 21 and the anti-vibration rubber 24.

As illustrated in FIGS. 3 and 4, the third structure 30 is constructed on the interior side of the second wall 22 (e.g., a three-ply sound insulation board) and includes a detachable flat panel 50 and an acoustic adjustment space 60 formed between the detachable flat panel 50 and the second wall 22 or the sound insulation board. A ceiling member 231 covers the bottom surface of the second ceiling 23, and a floor member 211 covers the upper surface of the second floor 21.

The upper end or the upper panel edge of the detachable flat panel 50 fits into an upper rail 51 fixed to the ceiling members 43 constituting the steel frame structure 40, and the lower end or the lower panel edge of the detachable flat panel 50 fits into a lower rail 52 fixed to the second floor 21. More specifically, the upper panel edge fits into and is held by the upper rail 51 via a vibration damping material 53, and the lower panel edge fits into and is held by the lower rail 52 via another vibration damping material 53.

The upper rail 51 is fastened with screws to the ceiling members 43 of the steel frame structure 40. The lower rail 52 is fastened with concrete screws to the second floor or concrete floating floor 21. The upper rail 51 has an extra inner space or a moving space that is greater than or equal to the height or depth of the lower rail 52.

With the above configuration, the detachable flat panel 50 can be detached by first lifting the entire panel upward such that the upper panel edge moves upward in the upper rail 51 and by pulling the upper panel edge out of the upper rail 51 while pulling the lower panel edge toward yourself to derail the lower panel edge from the lower rail 52.

On the other hand, the detachable flat panel 50 can be attached by first inserting the upper panel edge into the upper rail 51, pushing the lower panel edge away from yourself to a position above the lower rail 52 while lifting the entire panel upward, and then lowering the entire panel.

(Detachable Flat Panel)

Examples of detachable flat panels 50 are described below.

(1) Acoustic Adjustment Panel 50A

An acoustic adjustment panel 50A may be basically formed of a perforated calcium silicate board, perforated plywood, or a perforated aluminum board in which the diameter of holes, the pitch between holes, and the number of holes are optimized. Also, a glass wool sound absorbing material may be provided in the acoustic adjustment space 60. Furthermore, a sound absorbing material, a sound insulation material, a vibration damping material, and/or an acoustic adjuster provided inside of the acoustic adjustment space 60 described later is changeable. For example, a Helmholtz resonator or a columnar acoustic diffuser may be used as the acoustic adjuster.

(2) Sound Transmission Panel 50B

A sound transmission panel 50B may be basically formed of an ultrahard glass wool board the surface of which is covered with fabric cloth or glass cloth. Therefore, sound from a built-in speaker of a wall-mounted TV mounted in plane with the sound transmission panel 50B can be heard through the sound transmission panel 50B.

(3) Sound Insulation Panel 50C

A sound insulation panel 50C may be formed of structural plywood or a regular hard-type gypsum board. For example, glass wool with a density of 32 kg/m$^3$ and a thickness of 50 mm may be provided as a standard sound absorbing material in the acoustic adjustment space 60. Also, for example, a sound insulation material and/or a vibration damping material may be added to the acoustic adjustment space 60.

(4) Vibration Damping Panel 50D

A vibration damping panel 50D may be formed of a regular hard-type gypsum board with a thickness of 12.5 mm. A deadening sheet or a vibration damping material with a thickness of 2-3 mm may be attached to the entire back surface of the vibration damping panel 50D. Glass wool with a density of 32 kg/m$^3$ and a thickness of 50 mm may be provided as a standard sound absorbing material in the acoustic adjustment space 60. Installing the vibration damping panel 50D makes it possible to attach up to two deadening sheets to the acoustic adjustment layer (i.e., to the front surface of the sound insulation board 22 and the back surface of the vibration damping panel 50D) and makes it possible to double the vibration damping performance.

(Acoustic Adjustment Space)

The soundproof building structure S further includes the acoustic adjustment space 60 between the detachable flat panel 50 and the sound insulation board (e.g., the second wall 22) to adjust acoustics. A sound absorbing material, a sound insulation material, a vibration damping material, and/or an acoustic adjuster can be placed in the acoustic adjustment space 60.

Furthermore, the type, the thickness, and the quantity of each of the sound absorbing material, the sound insulation material, the vibration damping material, and the acoustic adjuster provided in the acoustic adjustment space 60 can be changed. For example, as a sound insulation material, one to three regular hard-type gypsum boards with a thickness of 12.5 mm can be additionally attached to the second wall 22. As a vibration damping material, one or two deadening sheets with a thickness of 2-3 mm can be attached to the front surface of the second wall 22 and/or the back surface of the vibration damping panel 50D. As a sound absorbing material, when standard glass wool has a density of 32 kg/m$^3$ and a thickness of 50 mm, glass wool with a density of 24 kg/m$^3$ and a thickness of 25 mm may be added. Also, the length, the thickness, and the number of Helmholtz resonant tubes or columnar acoustic diffusers used as acoustic adjusters may be changed. When the standard thickness of the third structure 30 is from 73 mm to 100 mm, the thickness of the acoustic adjustment space 60 is from a minimum of 65 mm to a maximum of 92 mm when the minimum thickness of the panel material is 8 mm.

(Appearance of Detachable Flat Panels)

Next, the appearance of the inside of a room in which detachable flat panels 50 are installed is described with reference to FIGS. 5 and 6.

Figure 5:
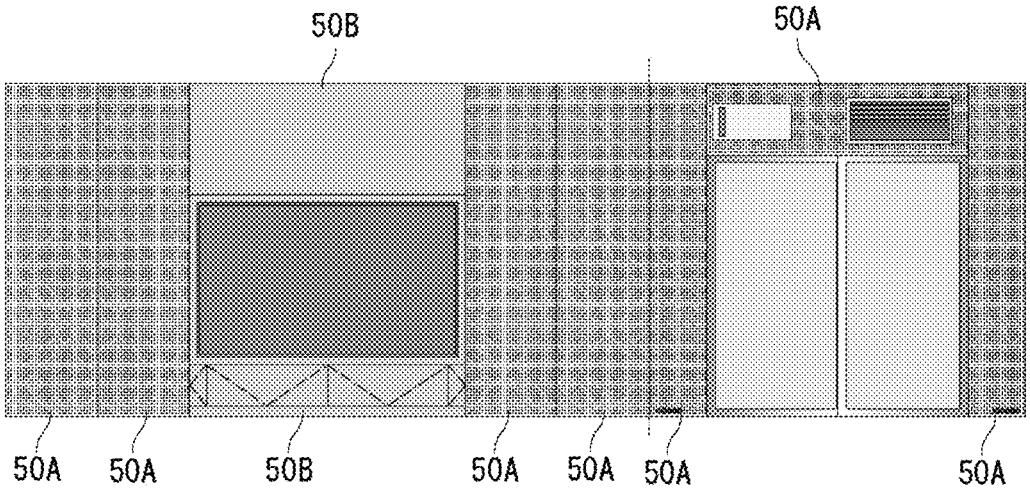
FIG. 5 is a front view of detachable flat panels.

As illustrated in FIG. 5, one side of a room may be constructed with acoustic adjustment panels 50A and sound transmission panels 50B, and a wall-mounted television may be placed between the sound transmission panels 50B. In this case, it is preferable to place speakers (not shown) inside of the sound transmission panel 50B. On another side of the room, an opening may be formed between acoustic adjustment panels 50A. Here, one of the acoustic adjustment panels 50A is provided above the opening.

Figure 6:
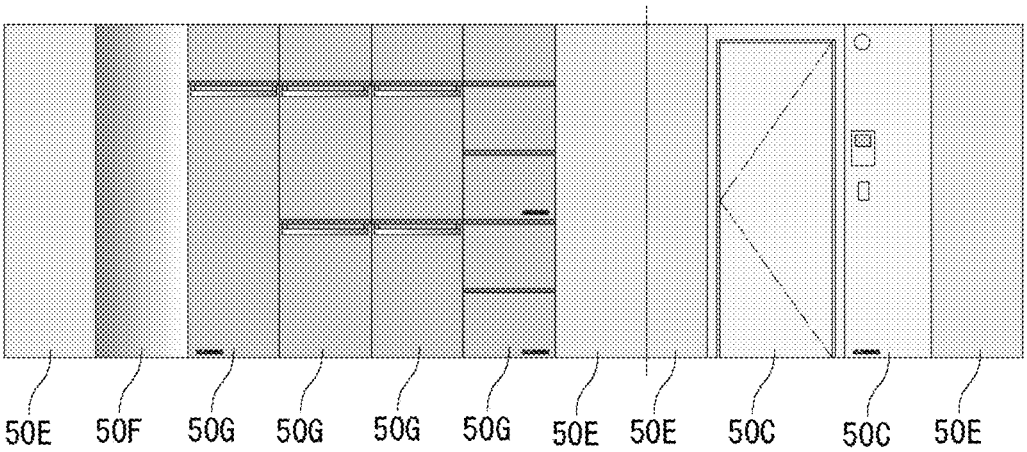
FIG. 6 is a front view of detachable flat panels.

As illustrated in FIG. 6, one side of a room may be constructed with color-tunable lighting panels 50E, a mirror panel 50F, and storage panels 50G. For example, the storage panels 50G may be equipped with shelves and hanger pipes. Another side of the room may be constructed with color-tunable lighting panels 50E and sound insulation panels 50C. An opening or a door with the same sound insulation performance as the sound insulation panel 50C may be formed between the sound insulation panels 50C.

Other Features

Other features 1 to 7 of the soundproof building structure S are described below.

Feature 1

Even after the completion of construction including main construction work and soundproofing work, the above-described configuration makes it possible to correct or enhance the soundproof performance that has varied from one room to another as a result of the soundproofing work by, for example, changing soundproof materials in the acoustic adjustment space 60 and without changing the effective area and the design of the room and thereby makes it possible to optimize acoustics, such as reverberation time, according to the type and position of musical instrument.

Feature 2

Other Variations of Detachable Flat Panels (1) Color-Tunable Lighting Panel 50E Capable of Steplessly Changing the Color Tone and Brightness of a Room A color-tunable lighting panel 50E may be implemented by glass that has a thickness of 10 mm or more and is covered with a milky-white anti-scattering film.

Wall washer line lighting devices are provided at the upper and lower ends of the acoustic adjustment space 60. When a lighting device with sufficiently high illuminance is used, the lighting device may be provided only at the lower end of the acoustic adjustment space 60.

(2) Storage Panel 50G

A storage panel 50G is preferably implemented by structural plywood with a thickness of 15 mm or more. Wall storage parts (e.g., mounting rails, shelves, and/or shelves with hanger pipes) are attached to the structural plywood.

(3) Mirror Panel 50F

A mirror panel 50F may be made by attaching a mirror with a thickness of 3 mm or more to structural plywood with a thickness of 12 mm or more.

(4) Mirror Storage Panel (not Shown)

A mirror storage panel is a composite panel made by combining a mirror panel with a storage panel. The mirror storage panel may be made by attaching a mirror with a thickness of 3 mm or more to structural plywood with a thickness of 12 mm or more.

As described above, there are various types of detachable flat panels 50 (50A-50G), and detachable flat panels 50 forming the same wall are completely in plane with each other or form a flat surface.

The width of each detachable flat panel 50 is basically 606 mm. However, the width may be reduced to, for example, 303 mm or 455 mm. Also, when the strength of the detachable flat panel 50 is increased by increasing its thickness, the width may be increased to, for example, 910 mm or 1000 mm.

The types and positions of detachable flat panels 50 can be changed. Also, the type, thickness, and quantity of a sound absorbing material, a sound insulation material, a vibration damping material, or an acoustic adjuster in the acoustic adjustment space 60 can be changed by detaching the detachable flat panels 50.

Feature 3

Upper and Lower Steel Rails for Supporting Detachable Flat Panels

The upper rail 51 (e.g., SUS t3.2) for supporting the detachable flat panels 50 is fastened with screws to the ceiling members 43 (e.g., C—100×50×20 t1.8) of the steel frame structure 40, and the lower rail 52 (e.g., SUS t3.2) for supporting the detachable flat panels 50 is fastened with concrete screws to the concrete floating floor 21.

Feature 4

The steel frame structure 40 is implemented by SS400 and includes a sound insulation layer that is formed of a massive three-ply regular hard-type gypsum board with a density of approximately 48.75 kg/m$^2$ and a sound absorbing layer that is formed by combining glass wool sound-absorbing materials with different densities and thicknesses (e.g., by filling a back air layer of the steel frame structure 40 with the sound absorbing materials).

Feature 5

The soundproof building structure S includes a "steel frame structure integrated with an acoustic adjustment panel" that is formed by securely fastening the upper and lower steel rails 51 and 52 for supporting the detachable flat panels 50 to the steel frame structure 40.

Feature 6

The soundproof building structure S may have a "room color tunable system" that can infinitely change the color tone of the entire room by using light that is emitted from a surface light source, e.g., a color-tunable and dimmable lighting panel, into a room and effectively diffuses. The room color tunable system may be implemented by blocking light with completely light blocking curtains and unifying the colors of all interior materials, such as walls, ceilings, floors, doors, window frames, air conditioning equipment, switch covers, and curtains, to the same achromatic color (e.g., white, light gray, gray, dark gray, or black).

The color-tunable and dimmable lighting panel may be implemented by, for example, an organic electroluminescent (EL) panel or milky glass that requires a separate light source on its back side.

The color tone may be controlled by using, for example, a smartphone, a tablet terminal, a switch, a touch panel, or a DMX controller or may be automatically controlled using a timer (e.g., the color temperature is lowered during night-time to induce sleep).

Feature 7

A wall mounting unit for a wall-mounted television can be screwed to a light-gauge steel stud fixed to the steel frame structure 40 through a three-ply sound insulation board, and the wall-mounted television can be installed such that the screen of the wall-mounted television is in plane with detachable flat panels forming a wall of a soundproof room.

Effects

Next, effects of the soundproof building structure S are described.

(1) As described above, the soundproof building structure S includes the first structure 10 including the first floor 11, the first wall 12, and the first ceiling 13, each of which is a concrete structure; the second structure 20 constructed in the first structure 10 and including the second floor 21 that has a vibration isolation structure and is constructed on the first floor 11, the second wall 22 constructed apart from the first wall 12, and the second ceiling 23 constructed apart from and below the first ceiling 13; and the third structure 30 constructed in the second structure 20 and including the detachable flat panel 50 disposed on the interior side of the second wall 22. With this configuration, it is possible to easily adjust the sound insulation performance and acoustics by detaching the detachable flat panel 50 even after construction.

That is, even after the completion of construction including main construction work and soundproofing work, the above-described configuration makes it possible to correct or enhance the soundproof performance that has varied from one room to another by, for example, changing soundproof materials in the acoustic adjustment space 60 and without changing the effective area and the design of a room, and thereby makes it possible to optimize acoustics, such as reverberation time, according to the type and position of musical instrument.

(2) The second structure 20 includes the steel frame structure 40 that stands by itself on the second floor 21, and the second wall 22 and the second ceiling 23 implemented by sound insulation boards are provided on the interior side of the steel frame structure 40. Providing the second structure 20 makes it possible to construct a building with high soundproof performance and high sound insulation performance. Specifically, the above configuration makes it possible to provide an inter-apartment wall and an inter-apartment floor with a sound insulation rating of Dr-85 or more and thereby makes it possible to play all types of musical instruments, such as a loud grand piano and live drums that generate vibrations, at any hours.

In this case, both of the wall 22 and the ceiling 23 may be constructed with substantially the same sound insulation structure by using a massive three-ply regular hard-type gypsum board with a density of approximately 48.75 kg/m$^2$ so that the wall 22 and the ceiling 23 have substantially the same sound insulation performance. This makes it possible to make the sound insulation performance of the entire building substantially uniform.

(3) The upper end of the detachable flat panel 50 fits into the upper rail 51 fixed to the ceiling members 43 constituting the steel frame structure 40, and the lower end of the detachable flat panel 50 fits into the lower rail 52 fixed to the second floor 21. This configuration makes it possible to attach and detach the detachable flat panel 50 extremely easily while maintaining the sound insulation performance of floors and ceilings.

(4) The acoustic adjustment space 60 for adjusting acoustics is provided between the detachable flat panel 50 and the sound insulation board 22. The acoustics of each room can be adjusted using the acoustic adjustment space 60. Because the acoustic adjustment space 60 is provided behind the detachable flat panel 50, the appearance and the design of the room does not change even when the acoustics are adjusted.

(5) A sound absorbing material, a sound insulation material, a vibration damping material, and/or an acoustic adjuster can be placed in the acoustic adjustment space 60. Therefore, it is possible to adjust the acoustics of each room to suit various types of sound sources.

(6) The acoustic adjustment panel 50A, which is formed of a perforated calcium silicate board, perforated plywood, or a perforated aluminum board, may be used as the detachable flat panel 50 to adjust the acoustics of each room.

(7) The sound transmission panel 50B, which is formed of a glass wool board, may be used as the detachable flat panel 50. This makes it possible to place speakers inside of the detachable flat panel 50 without compromising the acoustics.

(8) The sound insulation panel 50C, which is formed of structural plywood or a gypsum board, may be used as the detachable flat panel 50 to enhance the sound insulation performance of each room.

(9) The vibration damping panel 50D, which is formed of a gypsum board and a deadening sheet attached to the back surface of the gypsum board, may be used as the detachable flat panel 50 to efficiently attenuate vibrations generated in each room.

Other Effects

Other effects of the soundproof building structure S are described below.

1) The constructor and the resident or the user can freely customize the sound absorption performance, the sound insulation performance, and the vibration damping performance by using the acoustic adjustment space 60 behind the detachable flat panel 50.

2) An outlet can be embedded in a wall or a detachable flat panel without forming almost any hole in the sound insulation material of an inter-apartment sound insulation wall. This makes it possible to reduce the opening ratio of the sound insulation material and thereby improve the sound insulation performance. Also, because the outlet box and the electric wiring are not exposed, it is possible to improve the design of a room.

3) A wall-mounted television can be installed in plane with an interior finishing wall or a detachable flat panel. Because the sides of a flat-screen television panel are not exposed, its glass screen panel can be protected from lateral impact. The sound from the TV built-in speaker can be heard through the sound transmission panel. Thus, the spatial sound emitted from the built-in speaker is not blocked.

4) The color and the illuminance inside of a room can be freely controlled by using uniform light emitted from a surface light source, e.g., light that is emitted from a wall washer lighting device in the acoustic adjustment space 60 and transmitted through a detachable milky-white glass panel, without exposing any lighting device. Providing a DMX controller in a soundproof room makes it possible to frequently change the lighting color according to, for example, music, a floor impact sound made by dancing, and a voice and thereby makes it possible to realize an "at-home club". Because no lighting device is exposed on the ceiling, even when the ceiling height of a soundproof room is low, it does not give a feeling of pressure.

5) The number and positions of detachable mirror panels and detachable storage panels can be freely customized according to purposes, such as fitness and checking an instrument playing form, and the required storage capacity.

6) The amount of a sound absorbing material inside of detachable sound absorption panels can be adjusted according to the types and locations of musical instruments. This makes it possible to optimize room acoustics (e.g., the clarity of sound and reverberation time) even when musical instruments and residents change.

7) A booming phenomenon, in which low-pitched sounds unnaturally and excessively resonate, can be reduced by installing detachable sound absorbing panels in the corners of a soundproof room.

8) The sound insulation performance of specific rooms can be corrected or improved even when variation in the sound insulation performance among rooms is found by a sound insulation performance test conducted after the completion of construction. The sound insulation performance can be corrected without reducing the effective room area and without changing the design. Specifically, the sound insulation performance can be corrected by attaching the number of additional sound insulation boards (e.g., regular hard-type gypsum boards with a thickness of 12.5 mm) required for the desired sound insulation performance to a wall inside of the acoustic adjustment space 60.

9) The low-frequency vibration damping performance can be improved by attaching an inexpensive deadening sheet (e.g., a composite vibration damping material that is formed of aluminum foil and butyl rubber and has a thickness of about 2-3 mm) to the surface of a sound insulation material in the acoustic adjustment space 60. Exposing the surface of the aluminum foil of the deadening sheet on the inner surface of the acoustic adjustment space 60 makes it possible to cause sound waves, which are emitted from a sound source inside of a soundproof room and transmitted through a perforated panel, to collide with the surface of the thin aluminum foil, which is easily vibrated, and thereby makes it possible maximize the performance of the deadening sheet.

If the deadening sheet is sandwiched between sound insulation materials, the aluminum foil cannot vibrate, and the damping effect cannot be fully achieved. The deadening sheet with aluminum foil is not suitable for the finishing of indoor walls and is not normally used for the surface layer in a soundproof room. However, in the present disclosure, because detachable sound-absorbing panels are used for the indoor wall finishing surface, the deadening sheet can be used for the sound insulation wall surface in the acoustic adjustment space 60.

In an experiment in which a deadening sheet with a thickness of 2-3 mm was attached to the entire surface of a sound insulation material, the inter-apartment sound insulation performance was improved by approximately three decibels. An increase of three decibels indicates that the sound insulation performance has doubled after construction.

A plurality of embodiments of the present disclosure are described above with reference to the drawings. However, the present disclosure is not limited to the embodiments described above, and design changes may be made without departing from the spirit of the disclosure.

For example, in the above embodiments, the detachable flat panel 50 can be attached by fitting the upper and lower ends of the detachable flat panel 50 into the upper rail 51 and the lower rail 52 and can be detached by pulling out the upper and lower ends of the detachable flat panel 50 from the upper rail 51 and the lower rail 52. However, the detachable flat panel 50 may also be attached and detached in any other manners.

Figure 7A:
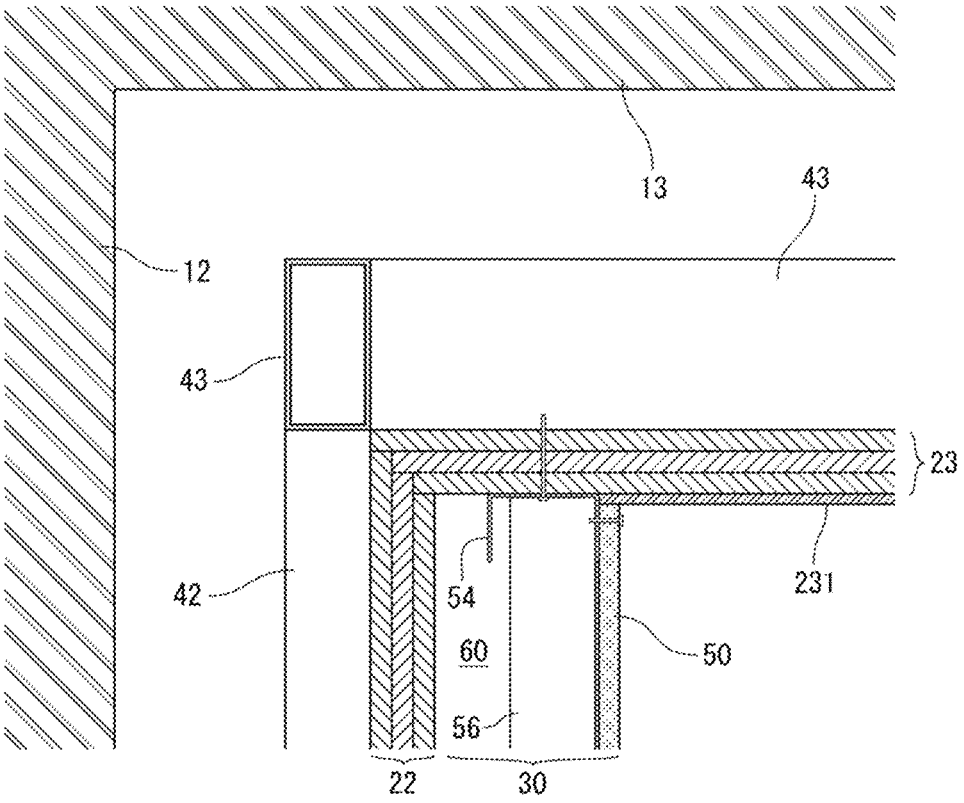
FIG. 7A is a cross-sectional view of a portion of a soundproof building structure near a corner of a ceiling and a wall according to a variation.
Figure 7B:
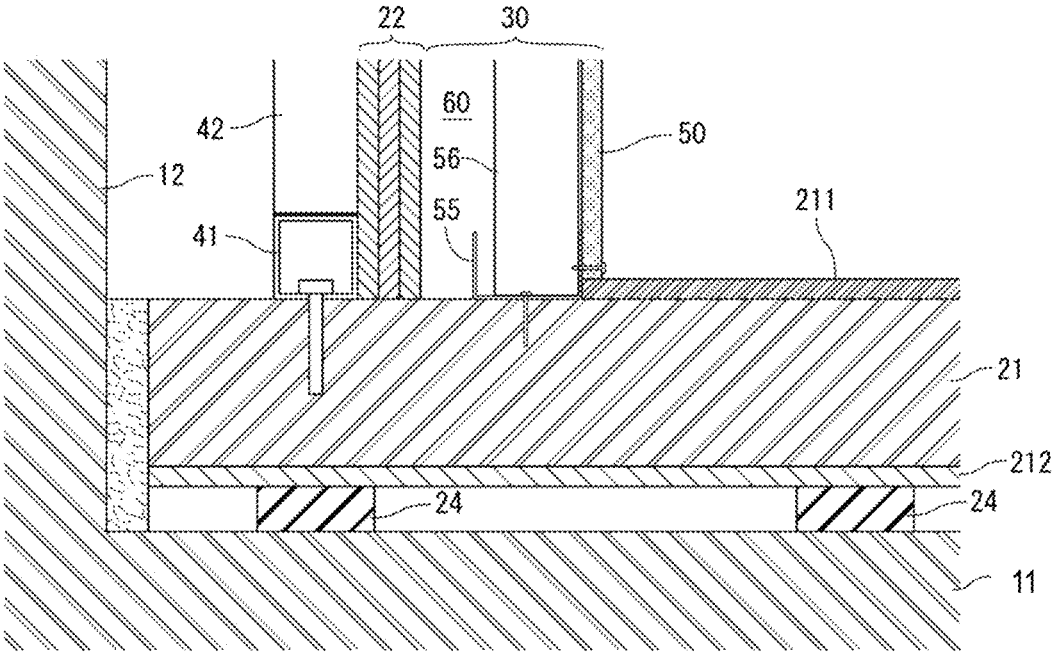
FIG. 7B is a cross-sectional view of a portion of the soundproof building structure near a corner of a floor and a wall according to the variation.

For example, when there is a risk that a detachable flat panel 50, such as the storage panel 50G, is bent by the load, as illustrated in FIGS. 7A and 7B, runners or channel steel 54 and 55 may be attached to the upper and lower ends of the acoustic adjustment space 60, a stud 56 having a 50 mm square shape may be placed between the runners 54 and 55, and the detachable flat panel 50 may be partially screwed to the stud 56.

While certain embodiments have been described, these embodiments have been presented by way of example only, and are not intended to limit the scope of the disclosure. Indeed, the novel embodiments described herein may be embodied in a variety of other forms; furthermore, various omissions, substitutions and changes in the form of the embodiments described herein may be made without departing from the spirit of the disclosure. The accompanying claims and their equivalents are intended to cover such forms or modifications as would fall within the scope and spirit of the disclosure.

What is claimed is:

1. A soundproof building structure comprising:

a first structure including a first floor, a first wall, and a first ceiling, each of which is a structure made of concrete;

a second structure disposed inside the first structure and including:

a second floor that has a vibration isolation structure and is on the first floor, a steel frame structure standing on the second floor apart from the first wall below the first ceiling, a second wall including a sound insulation board and disposed on an interior side of the steel frame structure, and a second ceiling including a sound insulation board and disposed on the interior side of the steel frame structure; and a third structure disposed inside the second structure and including a detachable flat panel disposed separately from the second wall on an interior side thereof such that an acoustic adjustment space is formed between the detachable flat panel and the second wall, wherein an upper end of the detachable flat panel fits into an upper rail fixed to a ceiling member of the steel frame structure, and a lower end of the detachable flat panel fits into a lower rail fixed to the second floor.

2. The soundproof building structure according to claim 1, wherein the second wall includes an outer layer that contacts the steel frame, an inner layer that faces the acoustic adjustment space, and an intermediate layer between the outer and inner layers.

3. The soundproof building structure according to claim 1, wherein another space extending parallel to the acoustic adjustment space is formed between the first wall and the steel frame structure.

4. The soundproof building structure according to claim 1, further comprising:

one or more of a sound absorbing material, a sound insulation material, a vibration damping material, and an acoustic adjuster in the acoustic adjustment space between the detachable flat panel and the second wall.

5. The soundproof building structure according to claim 1, wherein the detachable flat panel is a sound insulation panel including a structural plywood board or a gypsum board.

6. The soundproof building structure according to claim 1, wherein the detachable flat panel is a vibration damping panel including a gypsum board and a deadening sheet attached to a back surface of the gypsum board.

7. The soundproof building structure according to claim 1, wherein the steel frame structure includes a floor member extending along the second floor and a column member standing on the floor member and extending along the second wall, and the ceiling member of the steel frame structure extends parallel to the floor member and perpendicular to the column member.

8. The soundproof building structure according to claim 7, wherein each of the floor, column, and ceiling members is formed of light gauge steel and has a quadrangular cross section.

9. The soundproof building structure according to claim 7, wherein the steel frame structure includes a plurality of joists extending along the ceiling member.

10. The soundproof building structure according to claim 7, wherein the steel frame structure includes a plurality of studs extending along the column member.

11. The soundproof building structure according to claim 1, wherein the upper and lower rails are respectively fixed to the ceiling member and the second floor with concrete screws.

12. A soundproof building structure comprising:

a first structure including a first floor, a first wall, and a first ceiling, each of which is a structure made of concrete;

a second structure disposed inside the first structure and including:

a second floor that has a vibration isolation structure and is on the first floor, a second wall disposed apart from the first wall, and a second ceiling below the first ceiling; and a third structure disposed inside the second structure and including a detachable flat panel disposed separately from the second wall on an interior side thereof such that an acoustic adjustment space is formed between the detachable flat panel and the second wall, wherein the detachable flat panel is an acoustic adjustment panel including a perforated calcium silicate board, a perforated plywood board, or a perforated aluminum board.

13. The soundproof building structure according to claim 12, further comprising:

one or more of a sound absorbing material, a sound insulation material, a vibration damping material, and an acoustic adjuster in the acoustic adjustment space between the detachable flat panel and the second wall.

14. The soundproof building structure according to claim 12, wherein the detachable flat panel is a sound insulation panel including a structural plywood board or a gypsum board.

15. The soundproof building structure according to claim 12, wherein the detachable flat panel is a vibration damping panel including a gypsum board and a deadening sheet attached to a back surface of the gypsum board.

16. A soundproof building structure comprising:

a first structure including a first floor, a first wall, and a first ceiling, each of which is a structure made of concrete;

a second structure disposed inside the first structure and including:

a second floor that has a vibration isolation structure and is on the first floor, a second wall disposed apart from the first wall, and a second ceiling below the first ceiling; and a third structure disposed inside the second structure and including a detachable flat panel disposed separately from the second wall on an interior side thereof such that an acoustic adjustment space is formed between the detachable flat panel and the second wall, wherein the detachable flat panel is a sound transmission panel including a glass wool board.

17. The soundproof building structure according to claim 16, further comprising:

one or more of a sound absorbing material, a sound insulation material, a vibration damping material, and an acoustic adjuster in the acoustic adjustment space between the detachable flat panel and the second wall.

18. The soundproof building structure according to claim 16, wherein the detachable flat panel is a sound insulation panel including a structural plywood board or a gypsum board.

19. The soundproof building structure according to claim 16, wherein the detachable flat panel is a vibration damping panel including a gypsum board and a deadening sheet attached to a back surface of the gypsum board.

* * * * *